US010066493B2

(12) United States Patent
Kloetzer et al.

(10) Patent No.: US 10,066,493 B2
(45) Date of Patent: Sep. 4, 2018

(54) ROTOR OF A TURBOMACHINE

(71) Applicant: MTU Aero Engines AG, Munich (DE)

(72) Inventors: Alexander Kloetzer, Fuerstenfeldbruck (DE); Dieter Hofmann, Dachau (DE)

(73) Assignee: MTU Aero Engines AG, Munich (DE)

( * ) Notice: Subject to any disclaimer, the term of this patent is extended or adjusted under 35 U.S.C. 154(b) by 341 days.

(21) Appl. No.: 14/546,699

(22) Filed: Nov. 18, 2014

(65) Prior Publication Data

US 2015/0139808 A1 May 21, 2015

(30) Foreign Application Priority Data

Nov. 19, 2013 (DE) ..... 10 2013 223 607

(51) Int. Cl.
*F01D 5/30* (2006.01)
*F01D 5/32* (2006.01)

(52) U.S. Cl.
CPC ..... *F01D 5/3038* (2013.01); *F01D 5/32* (2013.01)

(58) Field of Classification Search
CPC ..... F01D 5/30; F01D 5/303; F01D 5/3038; F01D 5/32; F01D 5/326
See application file for complete search history.

(56) References Cited

U.S. PATENT DOCUMENTS 3,567,337 A * 3/1971 Zerlauth ..... F01D 5/3038 416/215
4,255,086 A * 3/1981 Roberts ..... F01D 5/3038 29/889.21
4,280,795 A 7/1981 Trousdell et al.
4,451,203 A 5/1984 Langley
5,846,054 A * 12/1998 Mannava ..... F01D 5/286 416/219 R
6,464,463 B2 * 10/2002 Yvon Goga ..... F01D 5/3038 416/215
7,708,529 B2 5/2010 Klingels
8,251,667 B2 * 8/2012 Wilson ..... F01D 5/3038 416/215
8,834,124 B2 9/2014 Belmonte et al.
2011/0116933 A1 * 5/2011 Aiello ..... F01D 5/32 416/215
2013/0022451 A1 1/2013 Aiello et al.

FOREIGN PATENT DOCUMENTS

| | | |
|---|---|---|
| DE | 724549 | 8/1942 |
| DE | 2237348 | 1/1974 |
| DE | 3210892 | 11/1982 |
| EP | 1028232 | 8/2000 |
| EP | 2368015 B1 | 2/2013 |
| EP | 2602435 | 6/2013 |
| WO | WO 2005/010323 | 2/2005 |

* cited by examiner

*Primary Examiner* — Igor Kershteyn
*Assistant Examiner* — Eric Zamora Alvarez
(74) *Attorney, Agent, or Firm* — Davidson, Davidson & Kappel, LLC

(57) ABSTRACT

A rotor of a turbomachine. The rotor includes at least one blade (4, 6, 8) that has a blade leaf (20) and a blade root (54, 55, 58), and a rotor base body (2), in particular a disk (2), that has an outwardly open, circumferential groove (12) for receiving the blade root (54, 55, 58). The circumferential groove (12) and the blade root (54, 55, 58) are shaped in a way that allows the blade root (54, 55, 58) to be secured in the circumferential groove (12) by the rotation of the blade (4, 6, 8) about an axis ($A_r$, $A_T$).

19 Claims, 5 Drawing Sheets

ROTOR OF A TURBOMACHINE

This claims the benefit of German Patent Application DE 102013223607.7, filed Nov. 19, 2013 and hereby incorporated by reference herein.

The present invention relates to a rotor of a turbomachine.

BACKGROUND

Such a rotor is known from the publication U.S. Pat. No. 7,708,529 B2. The rotor has a C-shaped, radially outwardly open circumferential groove in a rotor disk, the C-shaped circumferential groove having recesses at the side portions thereof. The blade roots are swiveled in through these recesses. This rotor also has an annular securing device that is fastened between a bottom side of the inner shroud of the blades and a radially outer surface of the rotor disk to prevent the blades from swiveling out of the circumferential groove.

This design is particularly disadvantageous since the transitions from such recesses to the projections of the rotor configured at the circumferential groove can weaken the rotor disk in terms of structural mechanics. This can occur to the point where such rotors can experience a notching effect at these transitions, allowing cracks to form accordingly at these locations. In the worst case, it can even lead to failure of a rotor.

SUMMARY OF THE INVENTION

It is an object of the present invention to overcome these disadvantages.

The present invention relates to a rotor of a turbomachine. The rotor includes at least one blade, which has a blade leaf and a blade root, and at least one rotor base body, in particular a disk that has an outwardly open, circumferential groove for receiving the blade root. The circumferential groove and the blade root are shaped in a way that allows the blade root to be secured in the circumferential groove by the rotation of the blade about an axis.

The advantage is hereby derived that the blades are already secured in the groove immediately following rotation. There is no need for further securing. Much installation time is saved in the process. The circumferential groove may be designed to have a low stress concentration factor.

One advantageous embodiment of the present invention provides that the axis extend in parallel to the normal of the rotation axis of the rotor base body. Alternatively thereto or in combination therewith, the axis extends radially to the rotor base body.

This is particularly advantageous since securing the blades then requires relatively small absolute movements. If a repair becomes necessary, a defective blade may be removed without the need for disassembling the rotor base body from the engine.

In another advantageous embodiment of the present invention, in the circumferential groove, the rotor includes a securing element, in particular a securing wire that rests against the bottom side of the blade root.

This is particularly advantageous since it effectively prevents the blades from falling into the circumferential groove when the rotor, respectively the disk no longer rotates, and the centrifugal force no longer presses the blades radially outwardly. The securing element may be embodied as a C-shaped securing wire and, in the uninstalled state, have a somewhat larger radius than in the installed state. Thus, the securing wire is inserted under preload into the circumferential groove and may be braced against all blades. The securing wire is thereby centered and does not make contact with the base portion of the circumferential groove. The securing element may be made of sheet metal.

Another advantageous embodiment of the present invention provides that the blade root have a guide element, in particular a guide groove, whose shape conforms to that of the securing element.

This is particularly advantageous since the blade first snaps into engagement when it is properly placed in the circumferential groove. It is not absolutely necessary that the securing element be located in the middle in the blade root. The guide groove may be formed in the bottom surface of the blade root or, however, laterally in the blade root.

Another advantageous embodiment of the present invention provides that the blade (in particular between the blade leaf and the blade root) feature an inner shroud that extends transversely to the blade leaf, so that, in the installed state, only a first crosspiece of the inner shroud, together with the disk, form a gap. The gap width may be zero, so that the first crosspiece makes contact with the disk, in particular with the downstream side portions of the disk. It should be noted that the inner shroud has an upstream crosspiece and a downstream crosspiece. The downstream crosspiece is preferably the first crosspiece. During operation of the engine (gas turbine operating at steady or non-steady state), the flow pressure then presses the individual blades against this first crosspiece and thereby ensures the correct axial positioning of the blades.

Another advantageous embodiment of the present invention provides that the narrow section of the circumferential groove be large enough to allow the blade root to be introduced into the circumferential groove upon rotation of the blades about the axis; and/or the narrow section between the side portions be small enough to allow the contact faces of the blade root to rest on the contact faces of the side portions in the installed state.

This is particularly advantageous since there is no need for the individual blades to be threaded through a passage introduced into the side portions and subsequently moved to the position thereof in the circumferential direction along the circumferential groove, in the worst case, even to the position diametrically opposite the passage. In accordance with the present invention, the blades may be introduced at any circumferential groove location. Here the advantage is derived that installation time may be saved. Moreover, there is no need for a passage that would weaken the disk material and constitute a potential rupture point.

Another advantageous embodiment of the present invention provides that the narrow section of the circumferential groove be greater than a depth of the blade root. Alternatively thereto or in combination therewith, the narrow section of the circumferential groove is smaller than the width of the blade root. In all cases, the width of the blade root is greater than the depth thereof; the width in the installed state of the blade reflecting the extent of the blade root in the axial direction of the rotor base body; and the depth reflecting the extent of the blade root in the radial direction of the rotor base body.

This is particularly advantageous in that the blades are introducible along a radial axis into the circumferential groove and are subsequently secured in the groove by rotation about the radial axis. Thus, when working with rotors having many rotor blades, the narrow section of the circumferential groove may turn out to be smaller, and there may be less material surrounding the circumferential groove, thereby allowing a slimmer and thus lighter rotor design.

In another advantageous embodiment of the present invention, the rotor includes a circumferential securing means that has a head portion having a receiving portion for part of at least one blade root. The blade root also has an overhang whose shape conforms to that of the receiving portion.

This is particularly advantageous since the circumferential securing means is joined in positive engagement with the adjacent blade. This prevents shifting of the blades within the circumferential groove. Two adjacent blade roots preferably have overhangs whose shapes are mutually conforming, so that they are disposed in the receiving portion of the circumferential securing means. The contact face of the receiving portion may be of any desired shape. It may be curved, plane, roof-shaped, spherical or cylindrical.

Another advantageous embodiment of the present invention provides that the rotor include a circumferential securing means having a foot portion that rests on the base portion of the circumferential groove.

The circumferential securing means may be fixed in position in the circumferential groove via different fastening types. Thus, a screw (for example, a setscrew) may be used to fasten the circumferential securing means to the disk. Also conceivable are sheet metal elements and/or wire elements.

Another advantageous embodiment of the present invention provides that the rotor base body include at least one cutout portion and/or a raised portion in the base portion of the circumferential groove. The circumferential securing means also includes a foot portion that is configured in the second cutout portion.

The cutout portion, in particular the second cutout portion, is preferably butterfly-shaped. The circumferential securing means is moved radially until the foot portion thereof is introduced into this cutout portion. Moreover, the cutout portion may include at least one other limit stop that extends transversely to the circumferential groove. The circumferential securing means may be rotated in the circumferential groove only to the point where the foot portion arrives at the limit stop. The limit stop ensures that the width of the circumferential securing means extends exactly orthogonally to the circumferential groove, since an overtwisting may be avoided. Moreover, the limit stop provides a circumferential securing to the disk by form-locking engagement therewith; i.e., rotation of the disk, together with the blades, circumferential securing means and securing element relative to one another in the circumferential direction is no longer possible. In contrast to the holder, the circumferential securing means preferably has no opening. Once the holder and the securing element have been introduced into the corresponding opening, the circumferential securing means serves as a limit stop for the securing element, so that it is no longer able to leave the position thereof. The circumferential securing device may also have a blind or through opening, however, for receiving the securing elements and fixing them in position.

A raised portion may be preformed on the base portion of the circumferential groove and project radially outwardly, thereby forming one unit with the disk.

Another advantageous embodiment of the present invention provides that the width of the head portion of the circumferential securing means be larger than the narrow section between the side portions.

Another advantageous embodiment of the present invention provides that the height of the circumferential securing means be at least as great as the groove height. In addition, to receive the circumferential securing means, the rotor includes at least one groove that extends transversely to the circumferential groove.

This is particularly advantageous since it prevents any movement of the circumferential securing means along the circumferential groove. Thus, the blades are also secured in the circumferential groove.

In another advantageous embodiment of the present invention, the circumferential securing means is lower in height than the groove. At least one side wall, in particular a side portion of the circumferential groove has, in particular, a third receiving portion for the circumferential securing means.

Thus, the circumferential securing means is likewise secured. This third receiving portion may preferably be circular segment shaped. Thus, the circumferential securing means may be rotated into the circumferential groove.

SUMMARY OF THE INVENTION

Preferred exemplary embodiments of the present invention are described in greater detail in the following with reference to the schematic drawing. In this context:

FIG. 1: shows an oblique view of a portion of a rotor including a few installed blades and a circumferential securing means;

FIG. 2: shows an oblique view of a few blades including a circumferential securing means and a holder;

FIG. 3: shows the same view as in FIG. 2, but with fewer blades;

DETAILED DESCRIPTION

Figure 1:
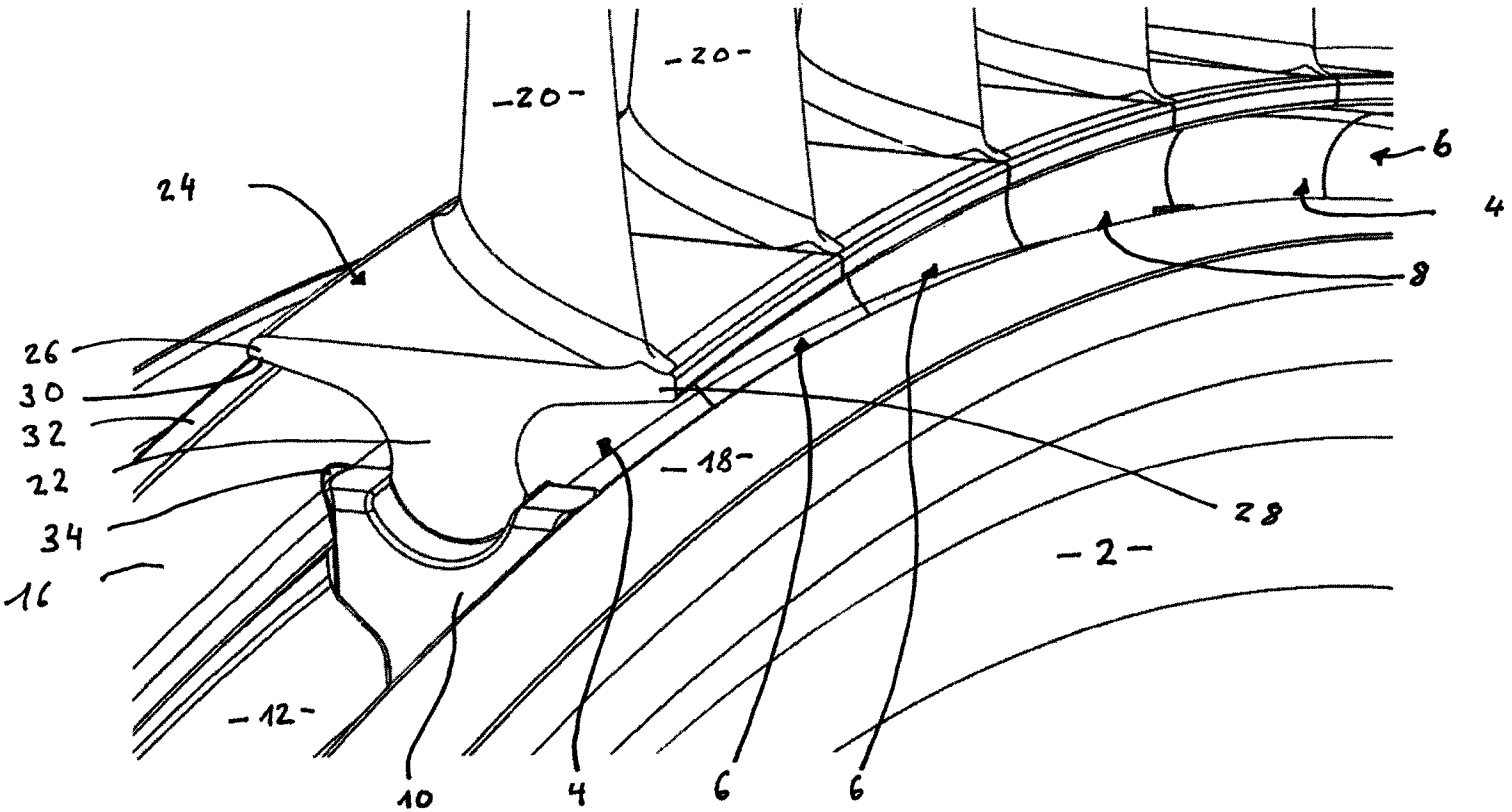

FIG. 1 shows an oblique view of a portion of a rotor having a rotor base body 2, including a few installed blades 4, 6 and 8 and a circumferential securing means 10. Rotor base body 2 may be a disk or a disk ring. In this specific embodiment, there are three different blades 4, 6 and 8 that differ, in particular, in the shape of blade roots 54, 55 and 58 (See FIG. 2) thereof in the circumferential direction. In particular, disk 2 features a C-shaped circumferential groove 12 in which are disposed blade roots 54 of first blade 4, blade roots 55 of second blade 6, and blade roots 58 of third blade 8. Circumferential groove 12 has a base portion 14 and, at each of the two ends of base portion 14, a side portion 16 and 18 (see also FIGS. 4A and 4B) that form the side walls of circumferential groove 12. Compared to upstream side portion 18 (referred to in the following as the second side portion), downstream side portion 16 (respectively the first side portion) has a larger radial dimension. Blade 4 features an inner shroud 24 that extends in the axial direction (of disk 2) between a radially outwardly extending blade leaf 20 and a radially inwardly extending blade root 22. Inner shroud 24 has a downstream crosspiece 26 (referred to in the following as the first crosspiece) and an upstream crosspiece 28 (referred to in the following as the second crosspiece). Bottom side 30 of first crosspiece 26 rests on top side 32 of first side portion 16.

In addition, circumferential groove 12 has a second, radially inwardly extending groove 34 that is recessed in both side portions 16 and 18. Circumferential securing means 10 is located in these two grooves 34.

Figure 2:
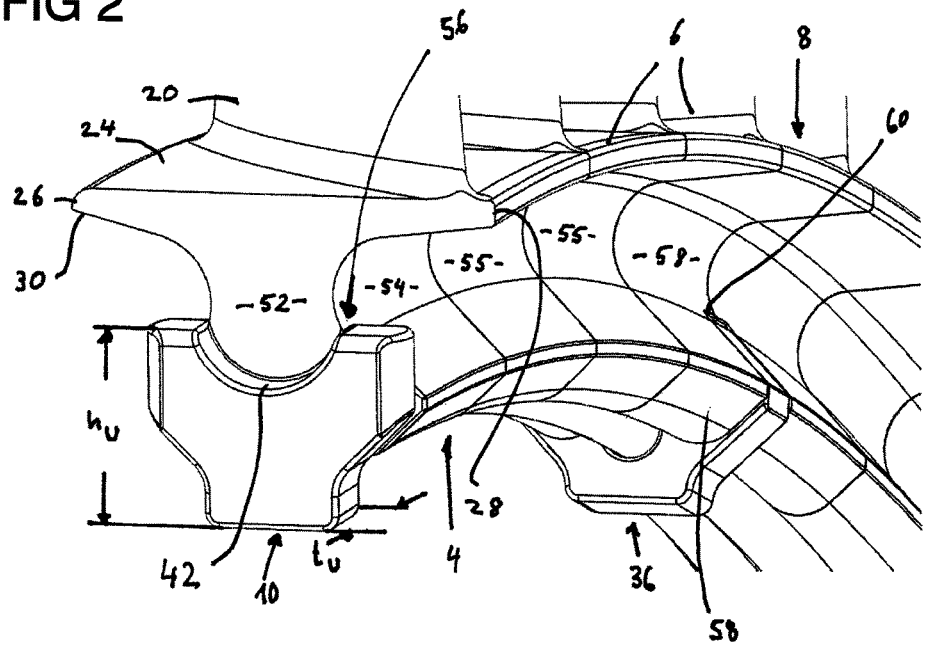
Figure 3:
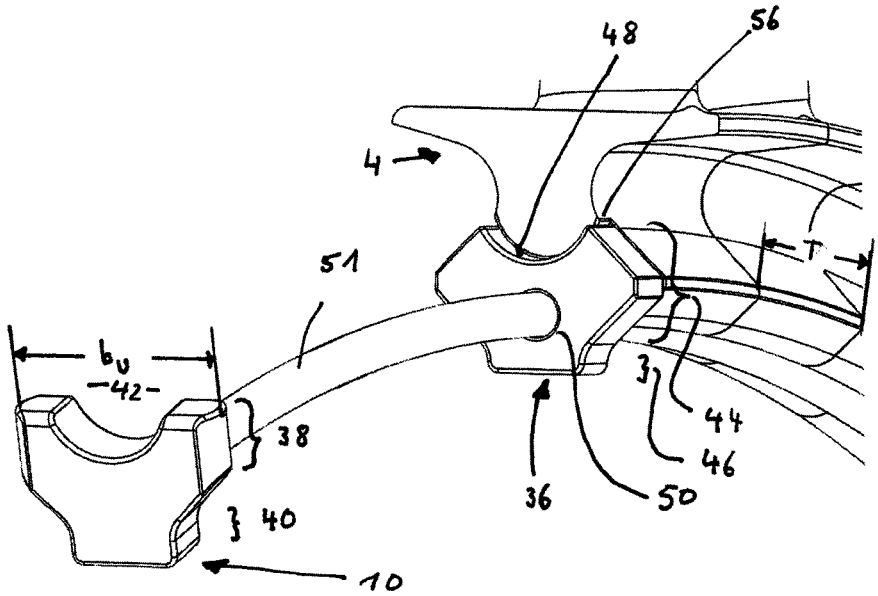

FIGS. 2 and 3 show an oblique view of a few blades including a circumferential securing means 10 and a holder, respectively wire holder 36. To facilitate understanding, disk 2 is not included in the illustration in FIGS. 2 and 3. The blades between circumferential securing means 10 and wire holder 36 are also not shown in FIG. 3 for the sake of better understanding. Circumferential securing means 10 is discernible in the front region. Circumferential securing means 10 has an essentially rectangular, upper head portion 38 and an essentially likewise rectangular foot portion 40. Height $h_U$ of circumferential securing means 10 extends in the radial direction of disk 2. Depth $t_U$ of circumferential securing means 10 extends circumferentially. Head portion 38 of circumferential securing means 10 extends axially in width $b_U$. Circumferential securing means 10 features a first, in this case arcuate, receiving portion 42 in head portion 38. Wire holder 36 has a head portion 44 and an essentially rectangular foot portion 46. Wire holder 36 features a second, in this case arcuate, receiving portion 48 in head portion 44. The two receiving portions 42 and 48 are preferably identical in shape. An opening 50, respectively a bore is recessed in the middle of wire holder 36. A securing element, respectively a securing wire 51 extends through this opening 50.

Three different blades 4, 6 and 8 having a depth T (see FIG. 3) are configured between circumferential securing means 10 and wire holder 36. These blades 4, 6 and 8 differ in the design of corresponding blade roots 54, 55, 58 in the circumferential direction. First blade 4 has a first blade root 54 where end face 52 facing circumferential securing means 10 has an overhang 56 whose shape conforms to that of first receiving portion 42. The end faces of second blade roots 55 of the two blades 6 are planar. Third blade 8 has a third blade root 58 where end face 52 facing wire holder 36 has an overhang 60 whose shape conforms to that of second receiving portion 48.

Figure 4A:
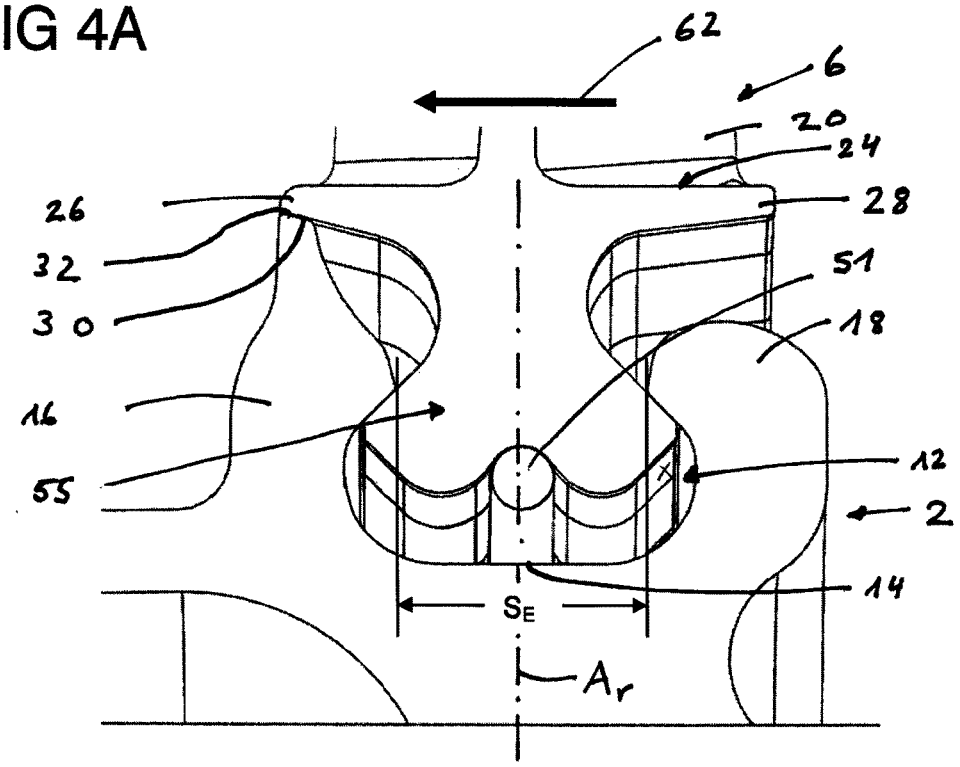
FIG. 4A shows a section transversely through the circumferential groove of the disk, the blade being depicted in the installed state.
Figure 4B:
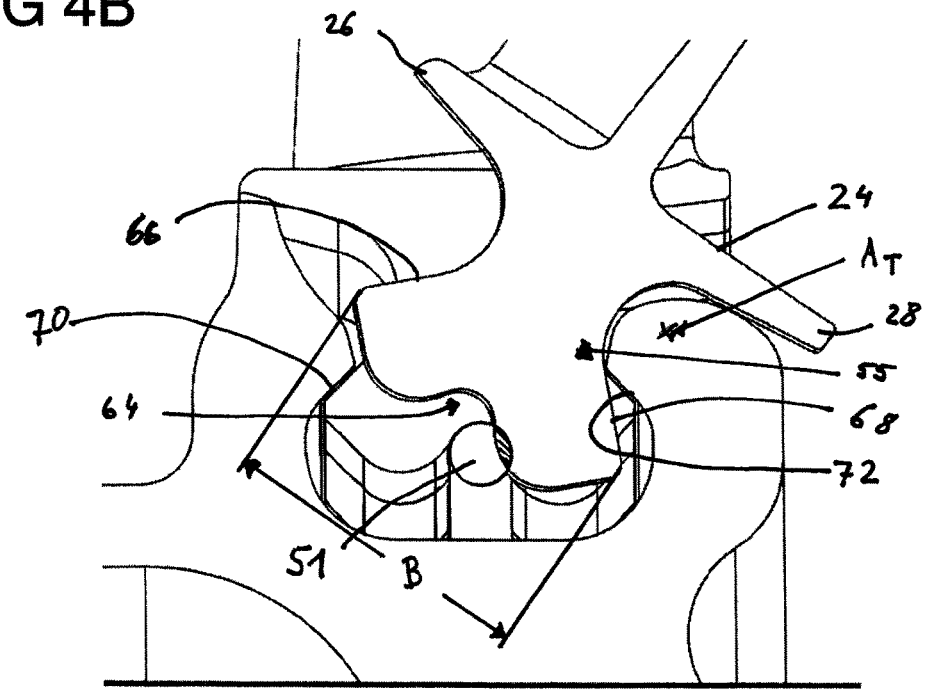
FIG. 4B shows a section transversely through the circumferential groove of the disk, the blade being depicted in the tilted state.

A section extending transversely through circumferential groove 10 of disk 2 is depicted in FIG. 4A; second blade 6 being illustrated in the installed state. A section through circumferential groove 10 of disk 2 is depicted in FIG. 4B; second blade 6 being illustrated in the tilted state where it will subsequently be rotated about axis $A_T$. The width of circumferential groove 10 at the narrowest location between side portions 16 and 18 is denoted as $S_E$.

During operation, the flow streams from right to left and is indicated by flow direction 62. The lower region of the second essentially dovetail-shaped blade root 55 of second blade 6 features a third groove 64 for accommodating securing wire 51. In this regard, other blade roots 54 and 58 may be similar in shape and, in the lower region, may have a groove similar in shape to groove 64. It should be pointed out that opening 50 of wire holder 36 aligns with third groove 64.

As illustrated in FIG. 4A, bottom side 30 of first crosspiece 26 rests on top side 32 of first side portion 16. Obliquely extending contact faces 66 and 68 of blade root 55 rest on obliquely extending contact faces 70 and 72 of circumferential groove 12. This narrow section $S_E$ between side portions 16 and 18 is large enough to allow blade root 55 (as well as other blade roots 54 and 58) to be introduced into circumferential groove 10 upon swiveling of blades 4, 6 or 8, for example about parallel axis $A_T$ of blade root 55; and narrow section $S_E$ between side portions 16 and 18 is small enough to allow contact faces 66 and 68 of blade root 55 to rest on contact faces 70 and 72 of side portions 16 and 18 in the installed state.

Alternatively, for example, second blade 6 (as well as the other blades) may be rotated about radial axis $A_r$ in order to be secured in circumferential groove 12. To this end, this second blade 6 is first radially moved along radial axis $A_r$; depth T of blade 6 being oriented in perpendicular to narrow section $S_E$. Only when blade root 55 has been inserted far enough into circumferential groove 12, is second blade 6 able to be rotated about radial axis $A_r$ until securing wire 51 snaps into third groove 64 (guide groove). Width B of second blade 6 is essentially oriented in parallel to narrow section $S_E$.

In this context, it is discernible in FIGS. 4A and 4B that width B of blade roots 55 is larger than narrow section $S_E$.

In accordance with the present invention, a certain number of blades 4, 6 and 8 are mounted using a form element, in this case securing wire 51 and one or a plurality of circumferential securing means 10 and one or a plurality of wire holders 36 in order to secure blades 4, 6 and 8 in a blade-disk assembly. The number of securing elements 10 and 36 and securing wires 51 used for this purpose is variable and determines the pitch and the number of required second radial grooves 34 in disk 2. Following completion of the entire assembly, circumferential securing means 10 serves as a limit stop for securing wire 51. It is thus circumferentially secured by form-locking engagement. Wire holders 36 are radially retained by dovetail contact surfaces 70 and 72 in disk 2. Wire holders 36, in turn, prevent securing wire 51 from falling out since they engage on disk 2 on base portion 14 in the direction of the rotation axis. The elasticity of securing wire 51 ensures that the blades may be tilted inwardly by a slight compression of securing wire 51 (see FIGS. 4B and 5). In response to first blade 4 tilting inwardly, for example, securing wire 51 yields to the side and radially downwardly, as shown by dashed lines in FIG. 5. Upon reaching the final installation position of the blade root, securing wire 51 springs back elastically into the neutral position thereof, so that this securing wire 51 engages in third groove 64. Since securing wire 51 is guided by positive engagement in third groove 64 of blade roots 54, 55 and 58, blades 4, 6 and 8 are held in the dovetail guide (circumferential groove 12) of disk 2, and are not able to tilt upon rotor standstill. Once installation is complete, circumferential securing element 10 is held in the radial direction by blade 4. In accordance with the present invention, wire holders 36 are held by a dovetail attachment in circumferential groove 12. Opening 50 of wire holder 36 is dimensioned to be large enough to ensure that securing wire 51 does not engage on this wire holder 36 under load.

The following describes one possible rotor installation. In the first step, circumferential securing means 10 may be installed by radial insertion into the corresponding grooves in disk 2. Following installation of circumferential securing means 10, wire holders 36 are rotated or tilted into circumferential groove 12 of disk 2. Subsequently thereto, securing wire 51 may be installed. This securing wire 51 is inserted through holes, respectively bores 50 of wire holders 36. Following installation of all securing elements, blades 4, 6 and 8 are mounted by tilting or by rotation. Blades 4 and 8 resting on the securing components (wire holder 36, respectively circumferential securing means 10) must first be swiveled into the circumferential groove in the proper sequence and be slid to the target position thereof in the circumferential direction. Subsequently thereto, remaining blades 6 may be assembled. The disassembly is carried out analogously in reverse sequence.

Figure 5:
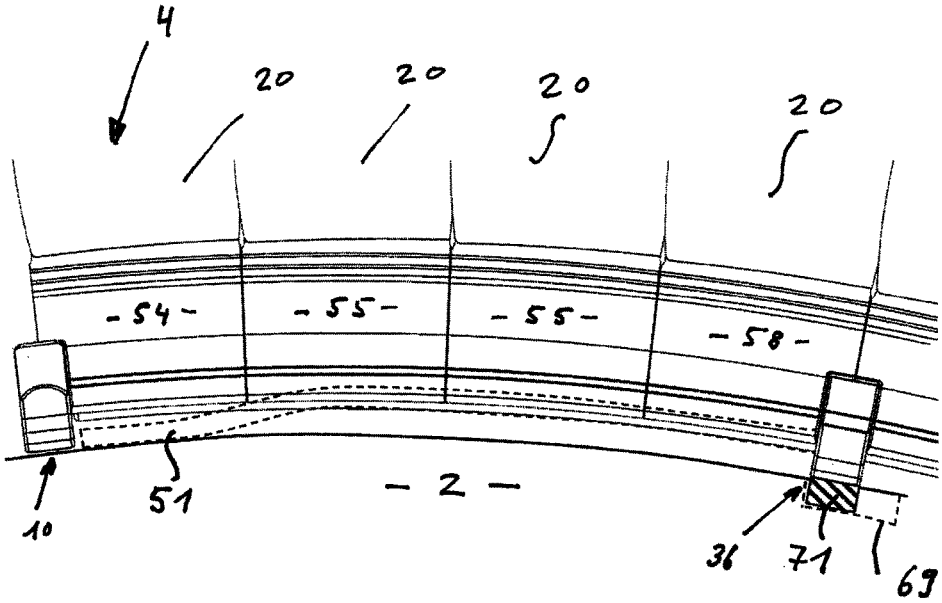
FIG. 5 shows an axial view of a portion of the rotor including installed blades.
Figure 6:
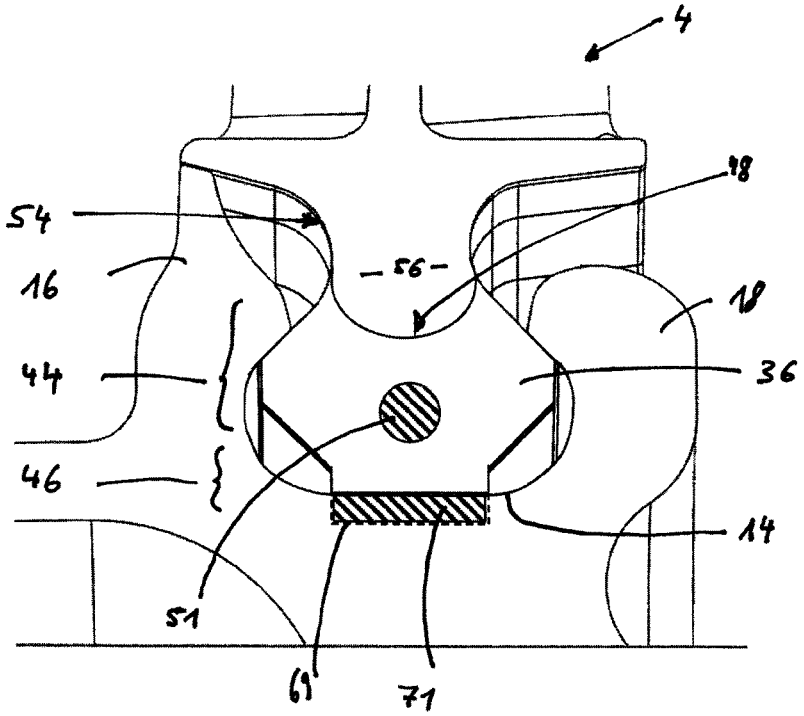
FIG. 6 shows a section transversely through the circumferential groove of the disk, the holder being depicted.

FIG. 6 depicts a section through circumferential groove 12 of disk 2; in head portion 44, wire holder 36 featuring second receiving portion 48. Disposed therein is overhang 56 of first blade root 54 of first blade 4. Two specific embodiments of foot portion 46 of wire holders 36 are illustrated in FIG. 6. The first specific embodiment of foot portion 46 reaches to base portion 14 of circumferential groove 12. In the second specific embodiment, radially inwardly extending, first, essentially butterfly-shaped cutout portion 69 is recessed in base portion 14 of the circumferential groove (see also FIG. 5, illustrated by a dashed line). Elongated region 71 of foot portion 46 (hatched region) is located in this first cutout portion 69.

Figure 7:
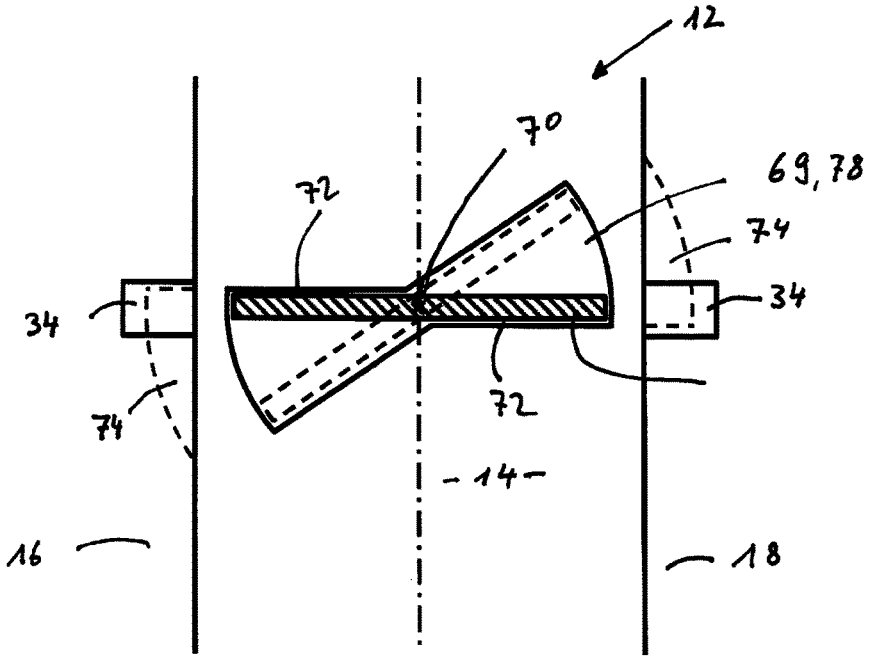
FIG. 7 shows a plan view of the circumferential groove in the radial direction.

FIG. 7 shows a plan view of circumferential groove 12 in the radial direction of first cutout portion 69 and of a second cutout portion 78 (in this regard, see further below). Illustrated in the middle and extending from top to bottom is circumferential groove 12. On the left, circumferential groove 12 is bounded by first side portion 16. On the right, circumferential groove 12 is bounded by second side portion 18. In first cutout portion 69, elongated region 71 is shown once with hatched shading and once with dashed lines. Upon installation of wire holder 36 into circumferential groove 12, wire holder 36 is introduced with the dashed-line orientation, orthogonally to the drawing plane. As soon as elongated region 71 is located in first cutout portion 69, wire holder 36 may be rotated clockwise about rotation axis 70 until elongated region 71 abuts limit stop 72 of first cutout portion 69 extending orthogonally to circumferential groove 12.

Figure 8:
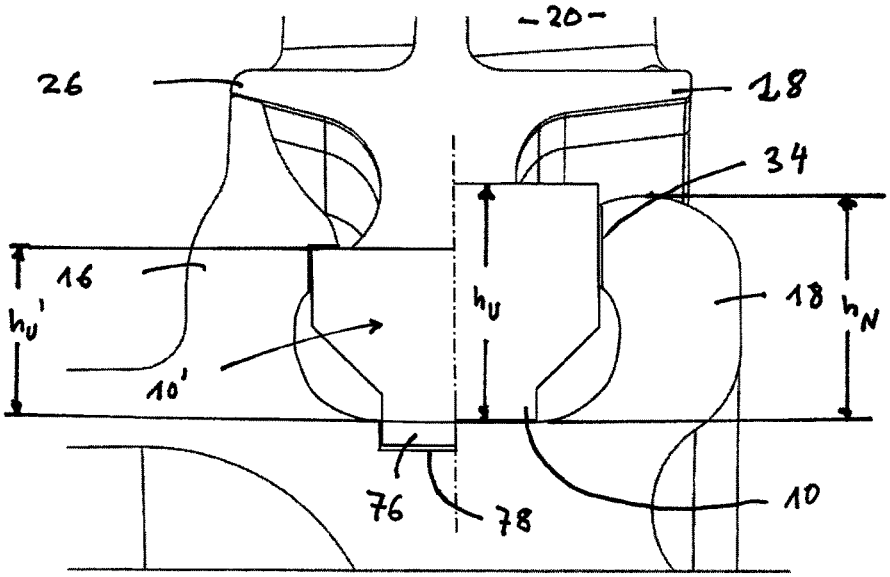
FIG. 8 shows a section transversely through the circumferential groove of the disk, two specific embodiments of the circumferential securing means being depicted.

FIG. 8 depicts a section through circumferential groove 12 of disk 2; two specific embodiments of circumferential securing means 10 being depicted. The first specific embodiment is shown on the right side. Circumferential securing means 10 corresponds to that shown in FIG. 1. It is inserted radially from the outside, inwardly into second grooves 34. It should be noted that second grooves 34 extend in the side portions from the outside, inwardly toward circumferential groove 12. These second grooves 34 are also illustrated in FIG. 7. Head portion 38 of circumferential securing means 10 is larger than narrow section $S_E$ between side portions 16 and 18.

In a second specific embodiment of circumferential securing means 10', height $h_U'$ of circumferential securing means 10' from base portion 14 to the end of head portion 38 is lower than groove height $h_N$. In contrast to the first specific embodiment, this circumferential securing means 10' is rotated into circumferential groove 12, in the same manner as wire holder 36. To this end, preferably arcuate, third receiving portions 74 (see FIG. 7) are recessed into side portions 16 and 18. In addition or alternatively thereto, circumferential securing means 10' may have an elongated foot portion 76, as does wire holder 36 in FIG. 6. In this context, circumferential groove 12 has a second cutout portion 78 for elongated foot portion 76. Second cutout portion 78 may have the exact same shape as first cutout portion 69. Circumferential securing means 10' is then rotated into circumferential groove 12 in the exact same manner as wire holder 36 having elongated foot portion 71.

The blades are secured circumferentially by the securing components that are used (circumferential securing means 10 and wire holder 36) that engage positively into circumferential groove 12 of disk 2. A form element (for example, securing wire 51) at blade roots 54, 55 and 58 prevents individual blades 4, 6 and 8 from tilting out. This securing wire helps to create a form-locking engagement for the entire blade-disk assembly. Circumferential securing means 10 prevents the wiring from slipping in the circumferential direction. In the installed state and, in particular, during operation, all of the securing wires are quasi strain-free and do not constitute a service life-reducing component. During operation, the securing elements (in particular, securing wires 51) rest over a large area on adjoining components. As a result, edge loads or concentrated loads and the associated stress peaks hardly occur in the material. The installation is carried out without the use of plastic deformation or screw connections. Therefore, undefined material stresses induced by deformation and, thus, potential crack formation are avoided. Due to the type of design, the centrifugal force of the securing elements is distributed during operation virtually uniformly over the blades. In addition, an appropriate design minimizes any asymmetric loading of the dovetail of blades 4, 6 and 8. In addition, there is no mechanical connection between disk 2 and securing wire 51. In particular, therefore, fretting between these two components is prevented.

Any number of securing wires over the entire circumference and any number of wire holders may be used on one single disk. If only one single, continuous securing wire is used, then it must extend over the entire rotor circumference. To simplify installation, the securing wire may be prebent.

The present invention may be used, in particular, in the compressor and turbine sections of turbomachines.

LIST OF REFERENCE NUMERALS

2 disk
4 first blade
6 second blade
8 third blade
10 circumferential securing means
12 circumferential groove
14 base portion
16 downstream side portion (first side portion)
18 upstream side portion (second side portion)
20 blade leaf
22 blade root of 4
24 inner shroud
26 first crosspiece
28 second crosspiece
30 bottom side of 26
32 top side of 16
34 second groove
36 wire holder
38 head portion of 10
40 foot portion of 10
42 first receiving portion of 10
44 head portion of 36
46 foot portion of 36
48 second receiving portion of 36
50 opening of 36
51 securing element
52 end face
54 first blade root of 4
55 second blade root of 6
56 overhang of 54

58 blade root of 8
60 overhang of 58
62 flow direction
63 bottom side of 8
64 guide element (third groove)
66 contact face
68 contact face
69 first cutout portion
70 rotation axis
71 elongated region of foot portion 46
72 limit stop
74 third receiving portion
76 elongated region of foot portion of 40
78 second cutout portion
79 gap
81 raised portion
$A_r$ radial axis
$A_T$ parallel axis
B width of blade root
$b_U$ width of head portion of circumferential securing means
$h_N$ groove height
$H_U$, $H_{U'}$ height of circumferential securing means
$S_E$ narrow section between the side portions
T depth of the blade root

What is claimed is:

1. A rotor of a turbomachine comprising:
at least one blade having a blade leaf and a blade root;
a rotor base body having an outwardly open, circumferential groove for receiving the blade root;
the circumferential groove and the blade root being shaped in a way to allow the blade root to be secured in the circumferential groove by rotation of the blade about an axis, and
a securing wire in the circumferential groove resting against a bottom of the blade root; and
a circumferential securing device having a head portion received radially inwardly in a pair of radially extending grooves in sidewalls of the circumferential groove.

2. The rotor as recited in claim 1 wherein the blade root has a guide, the guide having a shape conforming to the securing wire.

3. The rotor as recited in claim 2 wherein the guide is a guide groove.

4. The rotor as recited in claim 1 wherein a radially outer section of the circumferential groove is narrower than a radially inner section of the circumferential groove and the radially outer section allows the blade root to be introduced into the circumferential groove by rotation of the blades about the axis.

5. The rotor as recited in claim 4 wherein at least one contact face of the blade root rests on at least one contact face disposed in the circumferential groove.

6. The rotor as recited in claim 1 further wherein the circumferential securing device has a foot portion, wherein the circumferential securing device is attached to the securing wire, the securing wire extending circumferentially, and having a first receiving portion for part of at least one blade root; and the blade root has an overhang with a shape conforming to the first receiving portion.

7. The rotor as recited in claim 6 wherein the foot portion rests on a base portion of the circumferential groove.

8. The rotor as recited in claim 6 wherein a width of the head portion is larger than a narrow section of the circumferential groove.

9. The rotor as recited in claim 8 wherein a height of the circumferential securing device is at least as great as a height of the circumferential groove; and, to receive the circumferential securing device, the rotor includes at least one further groove that extends transversely to the circumferential groove.

10. The rotor as recited in claim 8 wherein a height of the circumferential securing device is lower than a height of the circumferential groove; and at least one side wall of the circumferential groove has a receiving portion for the circumferential securing device.

11. The rotor as recited in claim 1 wherein the rotor base body includes at least one cutout portion in a base portion of the circumferential groove.

12. The rotor as recited in claim 11 wherein the circumferential securing device has a foot portion, the securing wire extending circumferentially and is attached to a foot portion configured in the cutout portion.

13. The rotor as recited in claim 1 wherein the rotor base body is a disk.

14. A turbomachine comprising the rotor as recited in claim 1.

15. The rotor as recited in claim 1, wherein the circumferential securing device includes a foot portion received in a radially extending groove in a base of the circumferential groove.

16. A rotor of a turbomachine comprising:
at least one blade having a blade leaf and a blade root;
a rotor base body having an outwardly open, circumferential groove for receiving the blade root;
the circumferential groove and the blade root being shaped in a way to allow the blade root to be secured in the circumferential groove by rotation of the blade about an axis $A_r$ that extends radially to the rotor base body after insertion of the blade root into the circumferential groove, or by rotation of the blade about an axis $A_T$ that extends in a circumferential direction that is perpendicular to the axis $A_r$ after partial insertion of the blade root into the circumferential groove, and
a securing wire in the circumferential groove resting against a bottom of the blade root; and
a circumferential securing device having a head portion received in a pair of radially extending grooves in sidewalls of the circumferential groove.

17. A rotor of a turbomachine comprising:
at least one blade having a blade leaf and a blade root;
a rotor base body having an outwardly open, circumferential groove for receiving the blade root;
the circumferential groove and the blade root being shaped in a way to allow the blade root to be secured in the circumferential groove by rotation of the blade about an axis, and
a securing wire in the circumferential groove resting against a bottom of the blade root; and
a circumferential securing device having a head portion received in a pair of radially extending grooves in sidewalls of the circumferential groove,
wherein the blade features an inner shroud extending transversely to the blade leaf, the inner shroud having a downstream crosspiece and an upstream crosspiece, one of the downstream and upstream crosspieces being spaced apart from the rotor base body.

18. The rotor as recited in claim 17 wherein another one of the upstream and downstream crosspieces rests against the rotor base body.

19. The rotor as recited in claim 18 wherein the downstream crosspiece rests against the rotor base body.

* * * * *